US009915120B2

(12) United States Patent
Mercer et al.

(10) Patent No.: US 9,915,120 B2
(45) Date of Patent: Mar. 13, 2018

(54) SEAL ELEMENT

(71) Applicant: Petrowell Limited, Aberdeen (GB)

(72) Inventors: Lee Mercer, Aberdeen (GB); Stewart Christie, Aberdeen (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 523 days.

(21) Appl. No.: 14/529,860

(22) Filed: Oct. 31, 2014

(65) Prior Publication Data

US 2015/0053395 A1 Feb. 26, 2015

Related U.S. Application Data

(62) Division of application No. 12/743,397, filed as application No. PCT/GB2008/003883 on Nov. 19, 2008, now abandoned.

(30) Foreign Application Priority Data

Nov. 19, 2007 (WO) ..... PCT/GB2007/004372

(51) Int. Cl.

| | |
|---|---|
| ***E21B 43/16*** | (2006.01) |
| ***E21B 33/12*** | (2006.01) |
| ***E21B 23/02*** | (2006.01) |
| ***E21B 33/035*** | (2006.01) |

(52) U.S. Cl.

CPC ..... *E21B 33/1208* (2013.01); *E21B 23/02* (2013.01); *E21B 33/035* (2013.01)

(58) Field of Classification Search

CPC ..... F16J 15/00; F16J 15/002; F16J 15/021; F16J 15/3204; F16L 27/04; F16L 5/02; F16L 5/10; F16L 13/142; F16L 13/143

See application file for complete search history.

(56) References Cited

U.S. PATENT DOCUMENTS 2,284,340 A * 5/1942 Nuckles ..... F16J 15/3236 277/438
3,603,215 A * 9/1971 Leschisin ..... F04B 53/143 92/182
3,915,462 A * 10/1975 Bruns ..... F16J 15/021 277/647
4,143,586 A * 3/1979 Zitting ..... F16J 15/3204 277/437
4,457,523 A * 7/1984 Halling ..... F16J 15/021 277/644
4,779,901 A * 10/1988 Halling ..... F16L 27/04 285/184
4,787,642 A * 11/1988 Etheridge ..... E21B 33/04 277/550
4,900,041 A * 2/1990 Hopkins ..... E21B 33/04 166/115
5,735,344 A * 4/1998 Duncan ..... E21B 33/04 166/115

(Continued)

*Primary Examiner* — Vishal A Patel
(74) *Attorney, Agent, or Firm* — Blank Rome, LLP

(57) ABSTRACT

A seal element for sealing a conduit is described. The seal element comprises a frusto conical portion and a first lip extending from an external edge of the frusto conical portion, the lip being adapted to be pivoted into engagement with a conduit surface. In a described embodiment, two seal elements are provided on a plug for sealing a conduit, the seal elements facing in opposite directions to seal from above and below.

22 Claims, 6 Drawing Sheets

(56) References Cited

U.S. PATENT DOCUMENTS

| | | | | |
|---|---|---|---|---|
| 5,954,343 | A * | 9/1999 | Sumida | F02M 61/14 277/434 |
| 6,869,079 | B2 * | 3/2005 | Zheng | F16J 15/28 277/342 |
| 8,152,172 | B2 * | 4/2012 | Halling | F16J 15/022 277/644 |
| 9,140,388 | B2 * | 9/2015 | Baca | F16J 15/025 |

* cited by examiner

SEAL ELEMENT

FIELD OF THE INVENTION

The present invention relates to seal elements, particularly to seal elements used in the oil and gas industry.

BACKGROUND TO THE INVENTION

Conventionally well bores and apparatus associated with wellbores have been sealed with plugs and packers and the like. Plugs, for example, have three basic parts: an anchoring system, a seal element and a setting system.

The first stage in setting a conventional plug is anchoring the plug in the wellbore. Anchoring systems for conventional wellhead plugs use a set of locking dogs, which engage a recessed profile in the wellbore or tree, or use a set of slips which "bite" the casing to hold the plug in place.

The seal element is then set using a linear action setting mechanism to create a linear displacement to deform the seal element. The force required to create the seal is then locked in using a linear locking mechanism. In safety critical wellbore applications, for example sub sea trees, the seal is generally a metal-to-metal seal formed by swaging a metal ring element into the bore or onto a no-go shoulder.

To provide a seal capable of withstanding well pressures, the required setting force needs to be as high as the maximum force generated by the well pressure.

In recent years a number of high pressure, high temperature, high flow rate wells have been completed which have highlighted shortcomings in conventional designs of seal elements. For example, swaged seal elements can dislodge when exposed to the high pressure, temperature and vibration cycles of these wells, and the jarring action used to set the seal element can damage the seal element or the conduit or apparatus to be sealed.

A further disadvantage of conventional seal elements is that the expansion achievable from, for example, a metal seal element may not be sufficient to permit the apparatus incorporating the seal element to be run-into the wellbore with adequate clearance between the apparatus and the wellbore to prevent a build-up of pressure in front of the apparatus, resisting the placement of the apparatus. This can be a particular problem when a number of, for example, packers are to be located in series in a conduit, as a hydraulic lock can be formed between adjacent packers.

Furthermore, in cases where there is inadequate clearance, the metal seal element may engage the wellbore as the apparatus is run-in causing damage to the wellbore or to the seal element. If the seal element is damaged, this can result in an imperfect seal being formed by the seal element when the seal is set in its desired location.

In some instances, there is no clearance between the seal element and the conduit to be sealed and the seal element requires to be stabbed in which complicates running procedures and positional control.

SUMMARY OF THE INVENTION

According to a first aspect of the present invention there is provided a seal element for sealing a conduit, the seal element comprising:

a frusto conical portion; and a first lip extending from an external edge of the frusto conical portion; wherein the first lip is adapted to be pivoted outwardly into engagement with a conduit surface. In one embodiment, being able to pivot the seal element into engagement with a conduit surface, permits an apparatus utilizing the seal element to be run-into a bore with adequate clearance between the conduit wall and the seal element to prevent the buildup of pressure or to prevent damage to either the seal element or the wellbore surface, which may otherwise be caused by engagement during the run-in.

Preferably, the seal element is, in use, pivoted into engagement with the conduit surface by a setting force.

Preferably, the application of the setting force moves the seal element from a run-in configuration to a set configuration.

Preferably, in use in the set configuration, the frusto-conical portion is biased towards the run-in configuration.

Preferably, in use in the set configuration, the first lip is biased towards a conduit wall.

Preferably, the frusto conical portion is arranged, in use, to be biased against the direction of the setting force.

Preferably, in use, the first lip is biased against a resistance applied by engagement with the conduit wall.

Preferably, in use, the setting force bends at least a portion of the seal element from the run-in configuration to the set configuration.

Most preferably, the seal element is bent within its elastic limit. This ensures when the setting force is removed, the seal element moves from the set configuration towards the run-in configuration.

Preferably, the seal element bends around a living hinge between the frusto conical portion and the first lip.

Preferably, in moving from the run-in configuration to the set configuration, an outer edge of the frusto conical portion is displaced radially outwards. By this it is meant the movement of the outer edge includes a radial component which is outwards.

Preferably, upon removal of the setting force, the outer edge of the frusto conical portion moves radially inwardly. By this it is meant the movement of the outer edge includes a radial component which is inwards.

Preferably, for at least part of the radially inward movement of the outer edge of the frusto conical portion the first lip is adapted to remain in contact with a conduit surface.

In one embodiment, upon removal of the setting force, the first lip moves radially outwardly.

Preferably, upon removal of the setting force, in moving from the set configuration to the run-in configuration, the angle between the frusto conical portion and the first lip increases.

Preferably, upon removal of the setting force, the radially outward movement of the first lip is less than the radially inward movement of the frusto conical portion. Such an arrangement ensures that the first lip disengages from the conduit when the setting force is removed from the seal element and the seal element recovers from the set configuration towards the run-in configuration.

Preferably, the setting force is applied to the frusto conical portion.

Most preferably, there is no setting force applied to the first lip. Applying the setting force to the frusto conical portion ensures that the seal formed between the first lip and the conduit surface is a contact seal and, as such, minimal contact stress is caused to the conduit surface by engagement between the sealing surface of the lip and conduit itself. In one embodiment, the contact stress is controlled via the living hinge between the first lip and the frusto conical portion. The hinge provides the sealing energy. In this embodiment, the sealing contact is created in situ, providing seal performance and protection for the sealing surfaces Preferably, in use, the first lip is energized into engagement with the conduit wall by an applied pressure, such as a downhole or well pressure.

Preferably, the first lip comprises a ridge for engaging a conduit wall. Preferably, the ridge, in use, forms a seal with a conduit wall.

Preferably, the ridge has a constant radius profile.

Preferably, the seal element is a metal seal element.

Most preferably, the seal element is steel.

In one embodiment the steel is a noble steel. Alternatively, the seal element may be a polymeric material.

The seal elements may be formed by pressing. Alternatively, they may be spun or machined or manufactured by any suitable method.

Preferably, the seal element is adapted to be formed in a stack with other seal elements.

Preferably, the seal element comprises a second lip extending from an internal edge of the frusto conical portion.

Preferably, the second lip extends in the same direction as the first lip.

Preferably, the second lip is adapted to engage a portion of an apparatus. The apparatus may be a plug, a packer, or any apparatus which is suitable for creating, or adapted to create, a seal in a conduit or requires a seal to be created in a conduit.

The apparatus portion may be an apparatus surface.

Preferably, the second lip is adapted to form a seal with a portion of an apparatus Preferably, in use in the set configuration, the second lip is biased towards the apparatus surface.

Preferably, in use, the second lip is biased against a resistance applied by engagement with the apparatus surface.

Preferably, the seal element bends around a living hinge between the frusto conical portion and the second lip.

Preferably, for at least part of the radially inward movement of the outer edge of the frusto conical portion the second lip is adapted to remain in contact with the apparatus surface.

Preferably, upon removal of the setting force, in moving from the set configuration to the run-in configuration, the angle between the frusto conical portion and the second lip increases.

Preferably, there is no setting force applied to the second lip.

Preferably, in use, the second lip is energized into engagement with the apparatus surface by an applied pressure, such as a downhole or well pressure.

Preferably, during the setting of the seal element, the seal element, in use pivots around a contact point between the second lip and a plug surface.

Preferably, the second lip comprises a ridge for engaging the apparatus surface.

Preferably, the ridge, in use, forms the seal with the apparatus surface.

Preferably, the ridge has a constant radius profile.

In one embodiment the seal element is adapted to pivot about the second lip ridge.

The second lip ridge may slide with respect to the apparatus surface.

According to a second aspect of the present invention there is provided an apparatus for sealing a conduit, the apparatus comprising:

a body;

a setting device;

a seal element, the seal element comprising a frusto conical portion and a first lip extending from an edge of a frusto conical portion;

wherein relative movement of the setting device with respect of the body applies a setting force to the seal element, pivoting, in use, the first lip into engagement with a conduit surface.

In one embodiment the apparatus comprises a plurality of seal elements.

In this embodiment the seal elements may be arranged in a stack.

Alternatively or additionally, some of the seal elements may be facing the opposite direction to some other seal elements. Having the seal elements facing in the opposite directions can, in use, seal a conduit from pressure from above or below the apparatus.

Preferably, the seal element comprises a second lip adapted to engage a portion of the apparatus body.

Preferably, the setting device is moved axially with respect to the body.

Alternatively the setting device is pivoted with respect to the body.

According to a third aspect of the present invention there is provided a seal element for sealing a conduit comprising:

a frusto conical washer, the washer defining a lip extending from an external edge of the washer.

According to a fourth aspect of the present invention there is provided a seal element for sealing a conduit comprising a first portion biased away from forming a seal with the conduit and a second portion biased towards forming a seal with a conduit.

In one embodiment, a seal element according to the present invention can recover from a set configuration to a run-in configuration by removal of a setting force due to the first portion recovering a greater radial distance than the second portion.

According to a fifth aspect of the present invention there is provided a method of setting a plug and a conduit, the method comprising the steps of:

applying a setting force to a seal element having a frusto conical portion and a first lip extending from an external edge of the frusto conical portion; and pivoting the first lip into engagement with the conduit surface.

Preferably, the step of pivoting the first lip into engagement with the conduit surface comprises pivoting the seal element about a second lip extending from an internal edge of the frusto conical portion.

Alternatively or additionally, the step of pivoting the first lip into engagement with the conduit surface comprises bending at least a portion of the seal element.

According to a sixth aspect of the present invention there is provided a seal element for sealing a conduit, the seal element comprising:

a frusto conical portion; and a first lip extending from an external edge of the frusto conical portion;

wherein the first lip is adapted to be rotated into engagement with a conduit surface.

According to a seventh aspect of the present invention there is provided a seal element for sealing a conduit, the seal element comprising:

a frusto conical portion; and a lip extending from an internal edge of the frusto conical portion;

wherein the lip is adapted to be pivoted into engagement with a surface.

It will be understood that features listed as being non-essential with respect to one aspect may be equally applicable to another aspect and have not been re-stated for brevity.

BRIEF DESCRIPTION OF THE DRAWINGS

An embodiment of the present invention will now be described with reference to the accompanying drawings in which.

DETAILED DESCRIPTION OF THE DRAWINGS

Figure 1A:
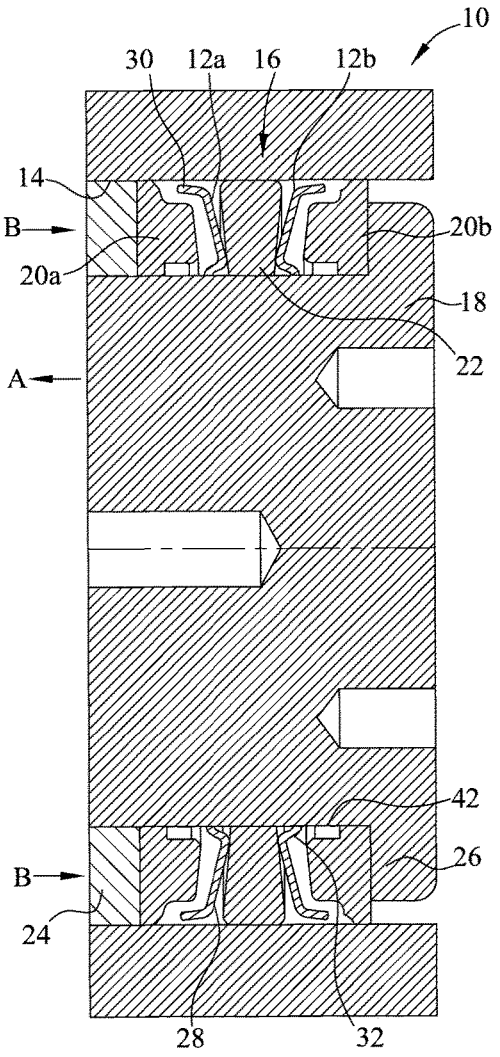
FIG. 1A is a section view of a plug in a run-in configuration, the plug having opposed seal elements according to an embodiment of the present invention.

FIG. 1A shows a section view of a plug, generally indicated by reference numeral 10, in a run-in configuration according to an embodiment of the present invention. The plug 10 has opposed seal elements 12*a*, 12*b* for forming a seal with the internal surface 14 of a conduit 16. In this run-in configuration, there is clearance between the seal elements 12 and the conduit surface 14 preventing damage to the conduit surface 14 and the seal elements 12 as the plug 10 is run into position.

Figure 1B:
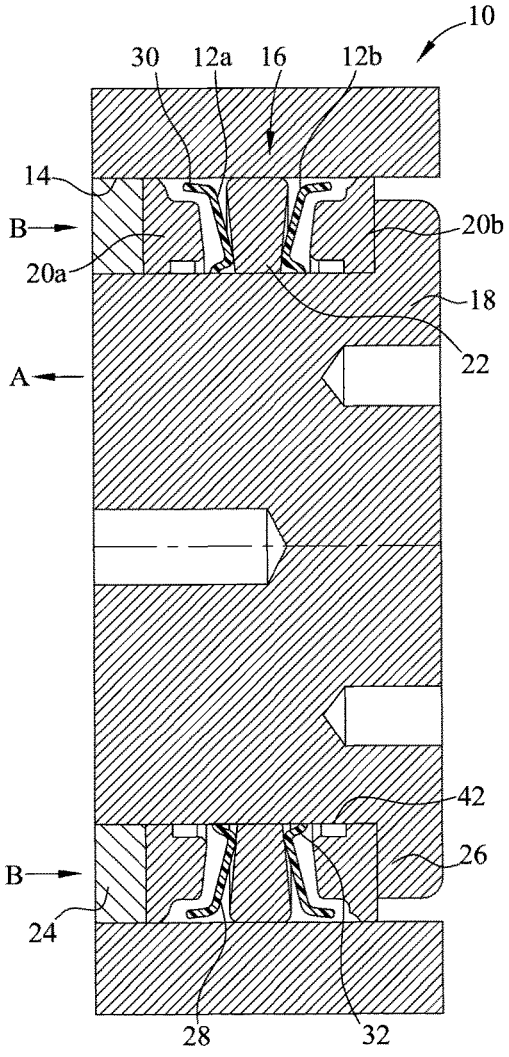
FIG. 1B is a section view of a plug in a run-in configuration, the plug having opposing polymeric seal elements according to an embodiment of the present invention.

As disclosed herein and shown in FIG. 1A, the seal elements 12*a*, 12*b* can be of metal material. As an alternative, FIG. 1B is a section view of a plug 10 in a run-in configuration, the plug 10 having opposing polymeric seal elements 12*a*, 12*b* according to an embodiment of the present invention.

The plug 10 further comprises a mandrel 18, a first seal setting ring 20*a*, a second seal setting ring 20*b*, a seal support ring 22 and a housing 24.

Figure 5:
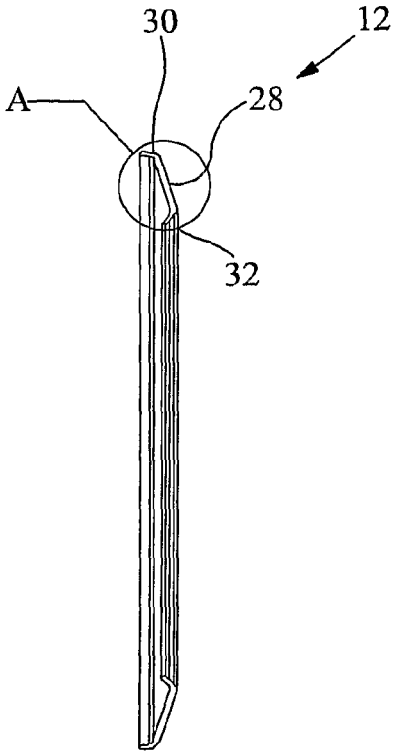
FIG. 5 is a section view through one of the seal elements of FIG. 1A.
Figure 6:
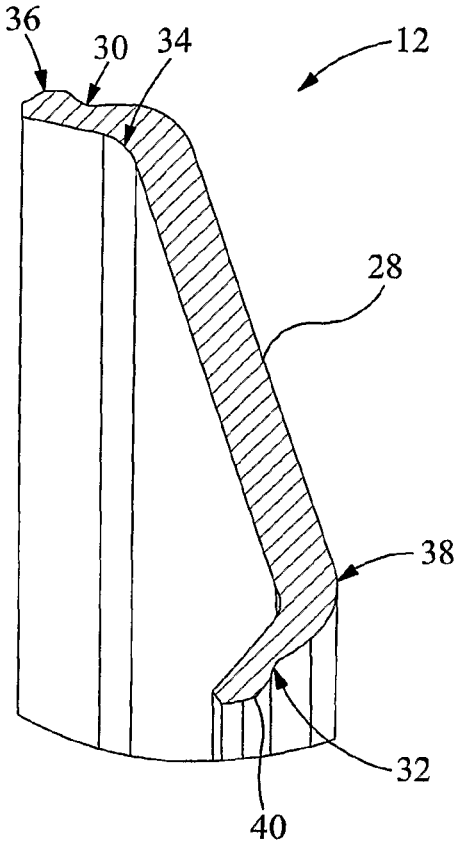
FIG. 6 is a close up of detail 'A' of FIG. 5.

Referring to FIG. 1A, FIG. 5, and particularly to FIG. 6, the seal elements 12 comprise a frusto conical portion 28, a first lip 30 and a second lip 32. The seal elements 12 are made from pressed from steel. The first lip 30 extends from an external edge 34 of the frusto conical portion 28. The first lip 30 also includes a constant radius ridge 36 for forming a contact seal with the conduit internal surface 14. The second lip 32 extends in approximately the same axial direction as the first lip 30 from an internal edge 38 of the frusto conical portion 28. The second lip 32 also comprises a constant radius ridge 40 for forming a contact seal with a mandrel surface 42 (FIG. 1A).

To set the seal elements 12 and create a seal, a pull force is applied to the mandrel 18 in the direction of arrow A (FIG. 1A) and a push force is applied to the housing 24 in the direction of arrow B. As relative movement is permitted between the mandrel 18 and the housing 24, the housing 24 acts on the first seal setting ring 20*a* which also moves in the direction of arrow B towards the first seal element 12*a*. A mandrel flange 26 moves in the direction of arrow A and acts on the second seal setting ring 20*b* which in turn engages and acts on the second seal element 12*b*. The seal elements 12 are prevented from axial movement by engagement with the seal support ring 22. The housing 24 applies a setting force to the first seal element 12*a* and the mandrel 14 applies a setting force to the second seal element 12*b*.

Figure 3:
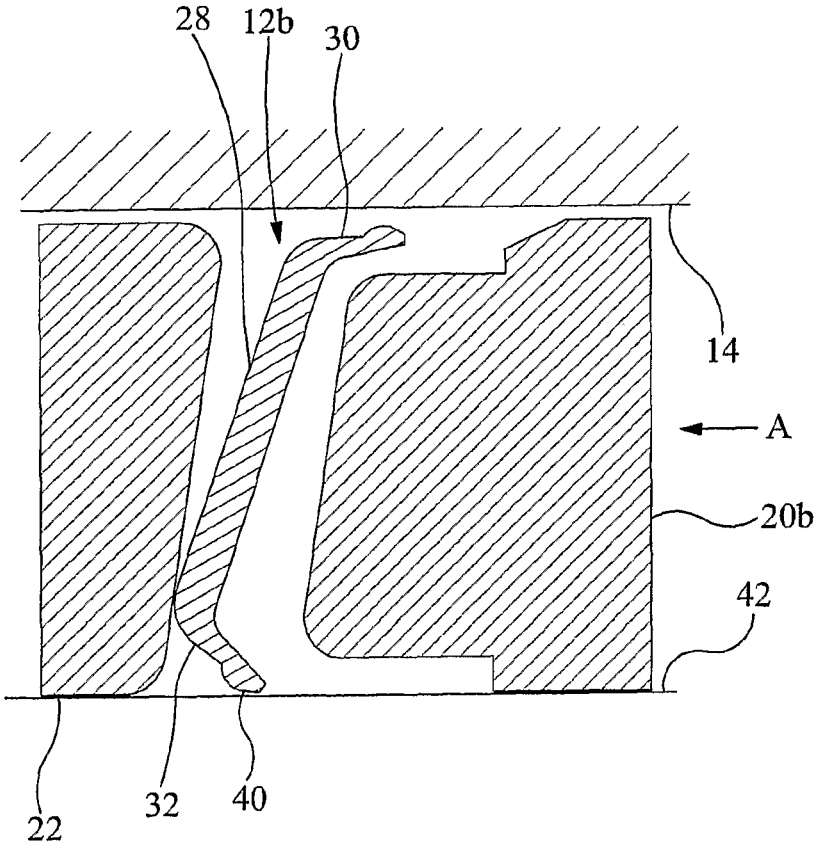
FIG. 3 is a close up of part of the plug of FIG. 1A in a run-in configuration.
Figure 4:
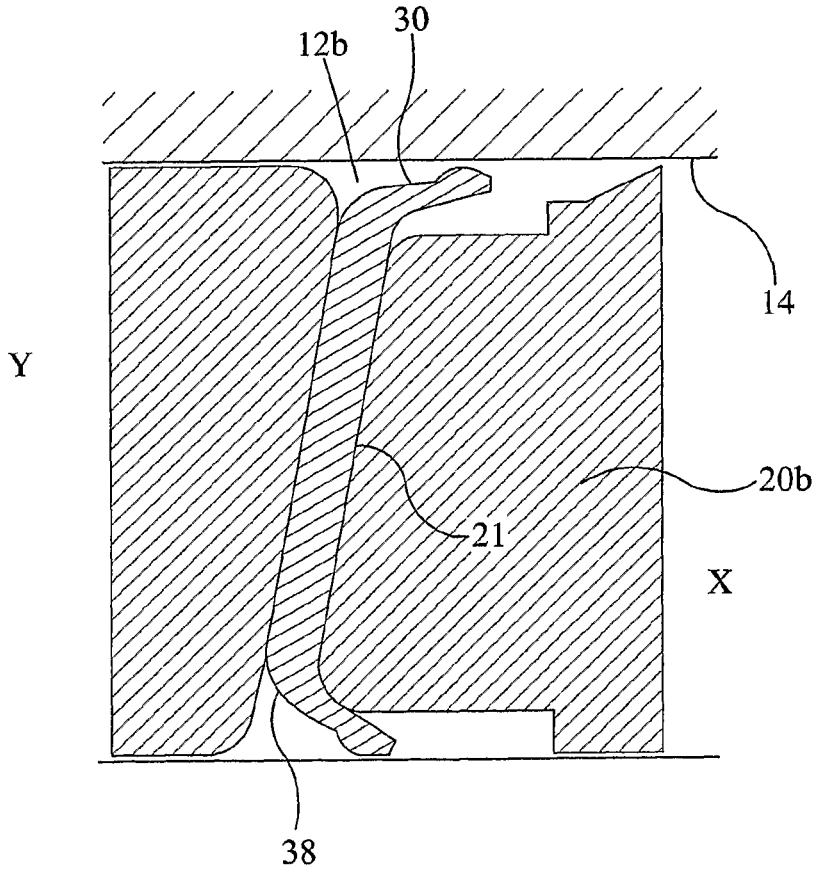
FIG. 4 is a close up of part of the plug of FIG. 1A in the set configuration.

The setting procedure is shown more clearly in FIGS. 3 and 4. FIG. 3 is a section view of part of the plug of FIG. 1A showing the second seal setting ring 20*b*, the seal support ring 22 and the seal element 12*b*. The seal element 12*b* is in the run-in configuration and is displaced from the conduit surface 14. The seal element inner lip 32 is in contact with the mandrel surface 42 and particularly the contact is made by the second lip ridge 40. As the second seal setting ring 20*b* moves in the direction of arrow A into contact with the frusto conical portion 28, the seal element 12*b* pivots about the second lip ridge 40 and particularly the first lip 30 pivots into engagement with the conduit surface 14.

Referring now to FIG. 4, a section view of part of the plug of FIG. 1A showing the seal element 12*b* in the set configuration. The seal element 12*b* has pivoted about the second lip ridge 40 and has bent at the internal edge 38 of the frusto conical portion 28; the interface between the frusto conical portion 28 and the second lip 38, such that a contact seal is formed between the first lip 30 and the conduit surface 14. Once the lip 30 has engaged the conduit surface 14, continued application of the setting force to the seal element 12*b* by the seal setting ring 20*b* results in the seal element 12*b* bending about the interface between the frusto conical portion 28 and the lip 30 at the frusto conical portion external edge 34. The deformation of the seal element 12 by the setting force is elastic deformation so that the seal element 12 can recover to the run-in configuration upon removal of the setting force.

The contact seal which is formed between the lip 30 and the conduit surface 14 will cause minimal damage to the conduit surface 14 because the setting force applied by the seal setting ring 20*b* (created by the pull of the mandrel 18 in the direction of arrow A and the push applied to the housing 24 in the direction of arrow B in FIG. 1A) acts primarily on the frusto conical portion 28 and does not act on the first lip 30.

The seal element 12*b* is arranged so that if the pressure downhole (indicated by "X" on FIG. 4) is greater than the uphole pressure (indicated by "Y") then the seal will be forced into a tighter engagement with conduit surface 14.

Figure 2:
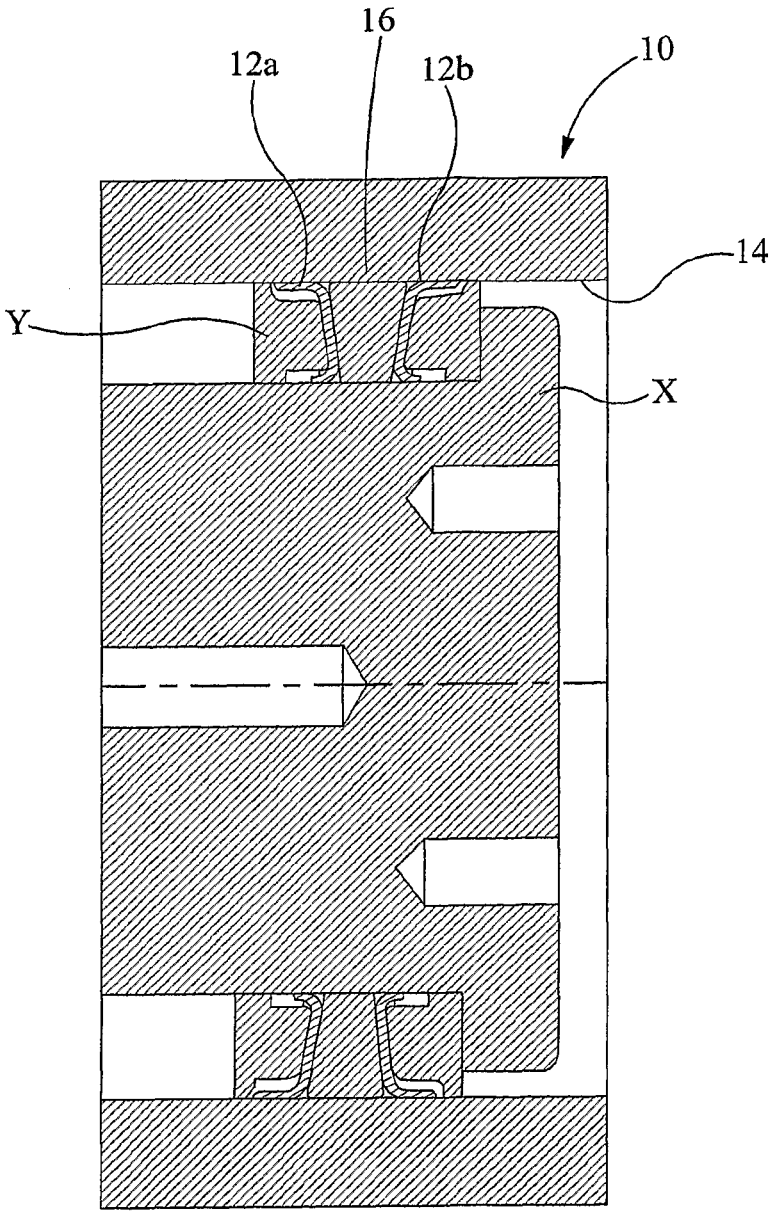
FIG. 2 is a section view through the plug of FIG. 1A in a set configuration.

Reference is now made to FIG. 2 which shows the plug 10 in the set configuration with the seal elements 12 fully engaged with the conduit surface 14. Two seal elements 12*a*, 12*b* are provided to create a seal in both directions. As was discussed with reference to FIG. 4 in the previous paragraph, the second seal element 12*b* will be forced into tighter engagement if the pressure downhole "X" is greater than the pressure uphole "Y" and similarly the first seal element 12*a* will be forced into tighter engagement if the pressure uphole "Y" is greater than the pressure downhole "X".

When the setting force is removed by moving the mandrel 18 in the direction of arrow B and the housing 24 in the direction of arrow A, the seal elements 12 can recover to the run-in configuration, permitting the plug to be recovered without damaging the conduit surface 14. It will be noted however that although the recovery of the seal elements 12 overall is away from the conduit surface 14, the recovery of the lip 30 is towards the conduit surface 14.

Various modifications and improvements may be made to the described embodiment without departing from the scope of the invention. For example although only two seal elements are used in the described embodiment, and the seal elements form individual seals sealing in opposite directions, each of these individual seal elements could be replaced by a stack of seals. Furthermore although the seal elements are described in conjunction with a plug, any suitable apparatus such as a plug or gasket could incorporate the seal elements. Additionally, the angle between the lips and the frusto conical portion could be increased or decrease to accommodate differing seal glands. Similarly the lip length could vary from that shown.

The invention claimed is:

1. An apparatus for sealing in a conduit in response to a setting force, the conduit having a cylindrical inner surface, the apparatus comprising:

a mandrel for positioning in the conduit, the mandrel having a cylindrical outer surface extending from a first end to a second end along a longitudinal axis;

a first seal element disposed about the cylindrical outer surface of the mandrel and having a flat frusto-conical ring, an internal annular lip, and an external annular lip, the flat frusto-conical ring having an inner circumferential edge adjacent the cylindrical outer surface of the mandrel and having an outer circumferential edge adjacent the cylindrical inner surface of the conduit, the flat frusto-conical ring being angled at an initial angle relative to the mandrel with a first side facing inward toward the mandrel and with a second opposite side facing outward toward the conduit, the internal annular lip extending away from the first side and a first extent from the inner circumferential edge of the flat frusto-conical ring along the longitudinal axis and adjacent to the outer cylindrical surface of the mandrel, the external annular lip extending away from the first side and a second extent from the outer circumferential edge of the flat frusto-conical ring along the longitudinal axis and adjacent to the inner cylindrical surface of the conduit; and a first setting ring disposed about the cylindrical outer surface of the mandrel toward the first end and having a first face, the first face facing the first side of the flat frusto-conical ring and being angled at a face angle different from the initial angle; and a second setting ring disposed about the cylindrical outer surface of the mandrel toward the second end and having a second face, the second face facing the second opposite side of the flat frusto-conical ring and being angled at the face angle, at least one of the first and second setting rings being movable from a run-in configuration displaced from the other to a set configuration displaced toward the other in response to the setting force, wherein in the set configuration of the apparatus, the flat frusto-conical ring is pivoted from the initial angel to the face angle sandwiched between the first and second faces, the external annular lip sealing an outer annular area between the first setting ring and the cylindrical outer surface of the conduit, the internal annular lip sealing an inner annular area between the first setting ring and the cylindrical inner surface of the mandrel.

2. The apparatus of claim 1, wherein at least one of:

said flat frusto-conical ring of said first seal element is biased towards the initial angle of the run-in configuration when the first seal element defines the set configuration; and said flat frusto-conical ring of said first seal element is biased in the initial angle against the direction of the setting force applied to said flat frusto-conical portion ring.

3. The apparatus of claim 1, wherein at least one of:

said external annular lip is biased towards the inner cylindrical surface of the conduit wall when the first seal element defines the set configuration; and said external annular lip is biased against a resistance applied by engagement with the inner cylindrical surface of the conduit.

4. The apparatus of claim 1, wherein at least part of said first seal element comprises a bendable portion, said first seal element configured so that the bendable portion bends from the run-in configuration to the set configuration in response to the setting force.

5. The apparatus of claim 1, wherein the outer circumferential edge of said flat frusto-conical ring is displaceable radially outwards when the flat frusto-conical ring is pivoted from the initial angel to the face angle; and wherein, upon removal of the setting force, the outer circumferential edge of the flat frusto-conical ring moves radially inwardly.

6. The apparatus of claim 5, wherein said first seal element is configured so that said external lip remains in contact with the cylindrical inner surface of the conduit for at least part of the radially inward movement of the outer circumferential edge of said flat frusto-conical ring.

7. The apparatus of claim 1, wherein said first seal element defines a first bend angle between said flat frusto-conical ring and said external annular lip when the first seal element defines the run-in configuration that is greater than a second bend angle when the first seal element defines the set configuration.

8. The apparatus of claim 1, wherein said external annular lip comprises a ridge disposed circumferentially thereabout for engaging the inner cylindrical surface of the conduit.

9. The apparatus of claim 1, wherein the first seal element comprises a metal material.

10. The apparatus of claim 1, wherein at least one of:

said internal annular lip has a distal end extending towards the longitudinal axis of the mandrel; and said internal annular lip extends in the same direction as said external annular lip.

11. The apparatus of claim 1, wherein said internal annular lip forms a seal with the outer cylindrical surface of said mandrel of said apparatus.

12. The apparatus of claim 1, wherein at least one of:

said internal annular lip is biased towards the outer cylindrical surface of the mandrel when said first seal element defines the set configuration; and said internal annular lip is biased against a resistance applied by engagement with the outer cylindrical surface of the apparatus surface.

13. The apparatus of claim 11, wherein said first seal element is configured to pivot around a contact point between said internal annular lip and the outer cylindrical surface of said mandrel of said apparatus.

14. The apparatus of claim 1, wherein said internal annular lip comprises a ridge disposed circumferentially thereabout for engaging the outer cylindrical surface of the mandrel.

15. The apparatus of claim 14, wherein at least one of:

said first seal element is configured to pivot about said ridge of said internal annular lip;

said first seal element is configured to slide said ridge of said internal annular lip with respect to said mandrel of said apparatus.

16. The apparatus of claim 1, comprising a plurality of said first seal elements arranged in a stack between the first and second setting rings.

17. The apparatus of claim 1, in combination with said conduit.

18. The apparatus of claim 1, wherein the first seal element comprises a polymeric material.

19. The apparatus of claim 1, wherein the first face angled at the face angle faces outward from the mandrel; and wherein the second face angled at the face angle faces inward toward the mandrel.

20. The apparatus of claim 1, wherein the second setting ring comprises an opposing second face opposite to the second face and facing toward the second end at an opposing face angle; and wherein the apparatus further comprises:

a second seal element disposed about the cylindrical outer surface of the mandrel adjacent the opposing second face of the second setting ring and having another flat frusto-conical ring, another internal annular lip, and another external annular lip arranged opposite to the first seal element; and a third setting ring disposed about the cylindrical outer surface of the mandrel further toward the second end and having a third face, the third face facing the second seal element and being angled at the opposing face angle, wherein the second and third setting rings and the second seal element mirror the first and second setting rings and the first seal element in the run-in and set configurations.

21. The apparatus of claim 20, further comprising:

a flange disposed on the first end of the mandrel adjacent to the first setting ring;

a housing disposed on the second end of the mandrel adjacent the third setting ring, the housing movable toward the flange with the setting force.

22. A method of sealing in a conduit, the conduit having a cylindrical inner surface, the method comprising:

providing an apparatus comprising:

a mandrel for positioning in the conduit, the mandrel having a cylindrical outer surface extending from a first end to a second end along a longitudinal axis;

a first seal element disposed about the cylindrical outer surface of the mandrel and having a flat frusto-conical ring, an internal annular lip, and an external annular lip, the flat frusto-conical ring having an inner circumferential edge adjacent the cylindrical outer surface of the mandrel and having an outer circumferential edge adjacent the cylindrical inner surface of the conduit, the flat frusto-conical ring being angled at an initial angle relative to the mandrel with a first side facing inward toward the mandrel and with a second opposite side facing outward toward the conduit, the internal annular lip extending away from the first side and a first extent from the inner circumferential edge of the flat frusto-conical ring along the longitudinal axis and adjacent to the outer cylindrical surface of the mandrel, the external annular lip extending away from the first side and a second extent from the outer circumferential edge of the flat frusto-conical ring along the longitudinal axis and adjacent to the inner cylindrical surface of the conduit; and a first setting ring disposed about the cylindrical outer surface of the mandrel toward the first end and having a first face, the first face facing the first side of the flat frusto-conical ring and being angled at a face angle different from the initial angle; and a second setting ring disposed about the cylindrical outer surface of the mandrel toward the second end and having a second face, the second face facing the second opposite side of the flat frusto-conical ring and being angled at the face angle;

moving at least one of the first and second setting rings from a run-in configuration displaced from the other to a set configuration displaced toward the other by applying a setting force to the at least one of the first and second setting rings;

pivoting the flat frusto-conical ring from the initial angel to the face angle sandwiched between the first and second faces in the set configuration of the apparatus;

sealing an outer annular area between the first setting ring and the cylindrical outer surface of the conduit with the external annular lip; and sealing an inner annular area between the first setting ring and the cylindrical inner surface of the mandrel with the internal annular lip.

* * * * *